US008640507B1

(12) United States Patent
Derman

(10) Patent No.: US 8,640,507 B1
(45) Date of Patent: Feb. 4, 2014

(54) HORIZONTAL SHACKLE FOR LOCK SYSTEM AND METHOD

(76) Inventor: Jay S. Derman, Palos Verdes Peninsula, CA (US)

( * ) Notice: Subject to any disclaimer, the term of this patent is extended or adjusted under 35 U.S.C. 154(b) by 206 days.

(21) Appl. No.: 13/342,854

(22) Filed: Jan. 3, 2012

Related U.S. Application Data

(60) Provisional application No. 61/532,796, filed on Sep. 9, 2011.

(51) Int. Cl.
*E05B 67/06* (2006.01)

(52) U.S. Cl.
USPC ..... 70/53; 70/14; 70/18; 70/33; 70/38 R; 70/233

(58) Field of Classification Search
USPC .... 70/32–37, 38 R, 39, 38 A, 38 B, 38 C, 53, 70/233, 14, 18
See application file for complete search history.

(56) References Cited

U.S. PATENT DOCUMENTS

| | | | | | |
|---|---|---|---|---|---|
| 100,402 | A | * | 3/1870 | Hillebrand | 70/37 |
| 274,875 | A | * | 3/1883 | Yoe | 70/437 |
| 557,522 | A | * | 3/1896 | Blake | 70/43 |
| 621,391 | A | * | 3/1899 | Turner | 70/32 |
| 906,294 | A | * | 12/1908 | Roschyk | 70/39 |
| 1,419,469 | A | * | 6/1922 | Paschke | 70/49 |
| 1,426,978 | A | * | 8/1922 | Gambino | 70/25 |
| 1,495,115 | A | * | 5/1924 | Setterberg | 70/34 |
| 1,681,416 | A | * | 8/1928 | Lichtenberger | 70/33 |
| 1,792,403 | A | * | 2/1931 | Stone | 70/33 |
| 1,971,797 | A | * | 8/1934 | Shinn | 70/32 |
| 2,104,981 | A | * | 1/1938 | Falk | 70/33 |
| 2,924,960 | A | * | 2/1960 | Palazzo | 70/180 |
| 2,963,895 | A | * | 12/1960 | Thomas | 70/14 |
| 2,999,377 | A | * | 9/1961 | Raye | 70/32 |
| 3,908,415 | A | * | 9/1975 | Foote | 70/49 |
| 4,183,235 | A | * | 1/1980 | Coralli et al. | 70/34 |
| 4,986,095 | A | * | 1/1991 | Chou et al. | 70/10 |
| 5,487,285 | A | * | 1/1996 | Leichel et al. | 70/18 |
| 5,732,577 | A | * | 3/1998 | Okada et al. | 70/18 |
| 6,159,025 | A | | 12/2000 | Derman | |
| 6,408,661 | B1 | * | 6/2002 | Chen | 70/33 |
| 6,662,607 | B2 | * | 12/2003 | O'Neal | 70/226 |
| 6,672,115 | B2 | | 1/2004 | Wyers | |
| 6,718,802 | B2 | * | 4/2004 | Vito | 70/18 |
| 6,793,081 | B1 | | 9/2004 | Derman | |
| 6,820,448 | B1 | * | 11/2004 | Hsieh | 70/18 |
| 7,076,976 | B1 | * | 7/2006 | Goldman | 70/33 |
| 7,165,426 | B2 | | 1/2007 | Wyers | |
| 7,225,649 | B2 | | 6/2007 | Wyers | |

(Continued)

OTHER PUBLICATIONS

Master Lock 605DAT, http://chetcomarine.com, pp. 1-2, accessed Feb. 1, 2012.
Master Lock 1475DAT 0.87 Long Shackle Barbell Lock, http://www.amazon.com, pp. 1-5, accessed Jan. 31, 2012.
Master Lock Shrouded Padlocks, http://www.masterlock.com, accessed Dec. 15, 2011.

(Continued)

*Primary Examiner* — Suzanne Barrett
(74) *Attorney, Agent, or Firm* — Aaron P. McGushion

(57) ABSTRACT

A padlock having a horizontal shackle is disclosed. The padlock may include a base comprising a latching mechanism, a first shackle aperture, and a second shackle aperture. The padlock may also include a shackle. The shackle may comprise a first post extending from within the first shackle aperture, a second post extending from within the second shackle aperture, and a horizontal cross member extending in a line from the first post to the second post.

12 Claims, 14 Drawing Sheets

(56) References Cited

U.S. PATENT DOCUMENTS

| | | | | |
|---|---|---|---|---|
| 7,698,915 | B2 * | 4/2010 | Wyers | 70/33 |
| 7,752,874 | B2 * | 7/2010 | Foti | 70/33 |
| 7,946,142 | B2 * | 5/2011 | Matyko et al. | 70/34 |
| D646,951 | S | 10/2011 | Tsai | |
| 8,186,186 | B1 * | 5/2012 | Mahaney et al. | 70/14 |
| 8,353,186 | B2 * | 1/2013 | Schaefer | 70/233 |

OTHER PUBLICATIONS

Meroni Barbell Padlock, http://onestop-padlocks.co.uk/meroni-barbell-padlock-22mm-red-p-12.html, accessed Jan. 31, 2012.

Padlock Barbell 1473, http://www.mrlock.com/36504.html, accessed Jan. 31, 2012.

Reese Towpower 7006000 Stainless Steel Dual Bent Pin Receiver Lock, http://www.amazon.com, pp. 1-5, accessed Aug. 31, 2011.

* cited by examiner

HORIZONTAL SHACKLE FOR LOCK SYSTEM AND METHOD

RELATED APPLICATIONS

This application claims the benefit of co-pending U.S. Provisional Patent Application Ser. No. 61/532,796 filed Sep. 9, 2011, which is hereby incorporated by reference.

BACKGROUND

1. The Field of the Invention

This invention relates to security systems and, more particularly, to novel systems and methods for securing personal property or other items.

2. The Background Art

Traditional padlocks include a U-shaped shackle. However, there are situations or applications where a U-shaped shackle may be unsuitable. Accordingly, what is need are improved shackles capable of securing items that are not well suited to traditional shackles.

BRIEF SUMMARY OF THE INVENTION

In view of the foregoing, in accordance with the invention as embodied and broadly described herein, a method and apparatus are disclosed in one embodiment of the present invention as including a lock protecting an item from theft, unauthorized use, unauthorized access, unwanted removal, or the like. In selected embodiments, a lock may comprise a padlock having a base and a shackle. A base may include a latching mechanism selectively controlling movement of a shackle.

A shackle may enable a lock to selectively engage and disengage one or more items or apertures therein. A shackle in accordance with the present invention may include two "vertical" members and a "horizontal" member. The vertical members may extend a selected distance away from a base. The horizontal member may comprise a straight shackle section extending between the vertical members.

In selected embodiments, each vertical member may include both an exterior portion and an interior portion. When a lock in accordance with the present invention is fully assembled and locked, the exterior portions of the vertical members may be positioned outside a corresponding base, while the interior portions may be received within corresponding apertures formed within the base.

A horizontal member may engage respective vertical members in any suitable manner. In certain embodiments, each exterior portion of each vertical member may include an aperture for receiving a corresponding end of a horizontal member. An end of a horizontal member may engage a corresponding aperture with any one of a slip fit, locking engagement, permanent engagement, or the like.

For example, one end of the horizontal member may engage one vertical member with a substantially permanent engagement (e.g., an engagement that cannot be easily or non-destructively released). The other end of the horizontal member may engage the other vertical member with a locking engagement. In certain embodiments, a circumferential groove and a lateral groove may be formed in one end of a horizontal member. A fixed or permanent extension (e.g., pin) may extend from a vertical member to engage the circumferential groove. This locking engagement may improve the strength of the securement provided by the lock, making it more resistant to prying or the like.

However, when the vertical member is released from the base, the vertical member may pivot about the end of the horizontal member until the extension is aligned with the lateral groove. At this location of alignment, the extension may pass, via the lateral groove, out of the circumferential groove and the vertical member may separate from the horizontal member. Once one or more items have been engaged by a shackle or removed therefrom, the process may be reserved.

BRIEF DESCRIPTION OF THE DRAWINGS

The foregoing features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF SELECTED EMBODIMENTS

Figure 1:
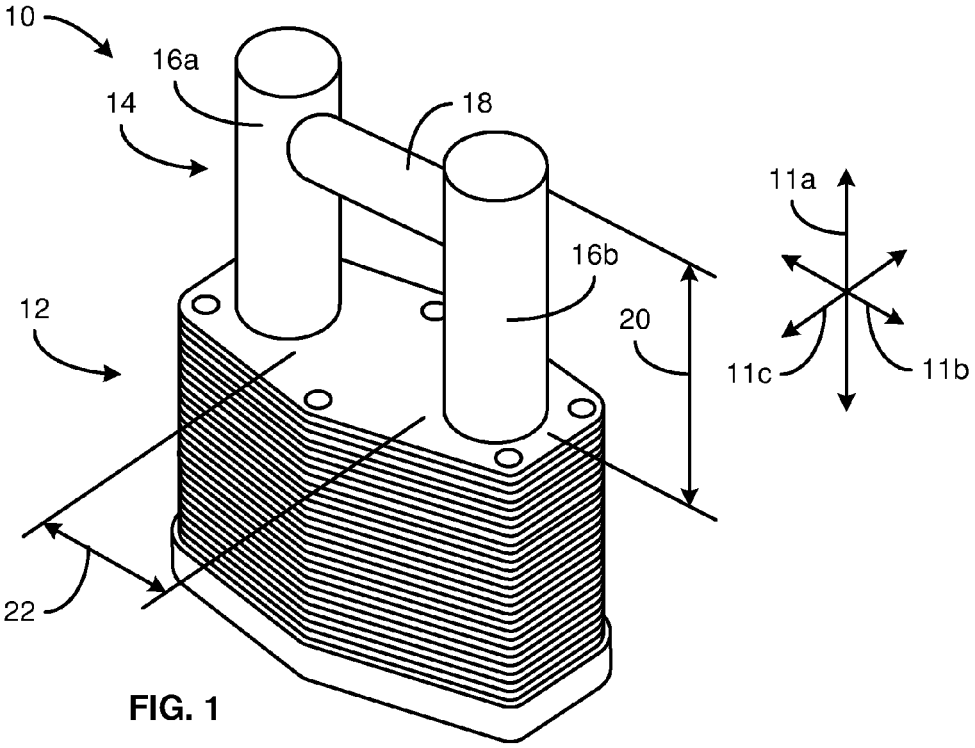
FIG. 1 is a perspective view of one embodiment of a padlock in accordance with the present invention, the padlock comprising a shackle secured to a base, the shackle comprising a first vertical member, a second vertical member, and a horizontal member.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, as claimed, but is merely representative of various embodiments of the invention. The illustrated embodiments of the invention will be best understood by reference to the drawings, wherein like parts are designated by like numerals throughout.

Referring to FIG. 1, in discussing a lock 10 in accordance with the present invention, it may be beneficial to first establish a reference frame. Accordingly, in selected embodiments, a lock 10 may be said to define a coordinate axes comprising a longitudinal direction 11*a*, lateral direction 11*b*, and transverse direction 11*c* extending substantially orthogonally with respect to one another.

A lock 10 may protect an item (e.g., valuable portable article, door, lid, or the like) from theft, unwanted removal, unauthorized use, unauthorized access, or the like. In selected embodiments, a lock 10 may be configured as a padlock having a base 12 and a shackle 14. A base 12 may include a latching mechanism selectively controlling movement of a shackle 14. A latching mechanism may be activated or actuated in any suitable manner. For example, a latching mechanism may be key activated. Alternatively, a latching mechanism may be activated (or deactivated) by entering a correct combination, password, or the like. In other embodiments, still other mechanisms or systems for controlling a latching mechanism may be employed.

A shackle 14 may enable a lock 10 to selectively engage and disengage one or more items or apertures therein. For example, a shackle 14 may enable a lock 10 to pass through a latch to secure a door, lid, or the like in a closed configuration. The shape of an item or items being secured may necessitate a shackle 14 of a particular shape or configuration. For example, in certain applications, a conventional curved or U-shaped shackle may be unsuitable. Accordingly, in certain applications, a horizontal or linear shackle 14 may be utilized.

A shackle 14 in accordance with the present invention may include a first member 16*a*, a second member 16*b*, and a third member 18. In selected embodiments, first and second members 16*a*, 16*b* may be considered to be "vertical" members 16*a*, 16*b*, while the third member 18 may be considered a crossing or "horizontal" member 18. First and second members 16*a*, 16*b* may extend a selected distance 20 in the longitudinal direction 11*a* from a base 12. The first and second members 16*a*, 16*b* may be spaced a selected distance 22 in the lateral direction 11*b* from one another. A third member 18 may comprise a horizontal shackle or straight shackle section extending between respective first and second members 16*a*, 16*b*.

The various sections or members 16*a*, 16*b*, 18 of a shackle 14 may have any suitable configuration or shape. The shape of the various members 16*a*, 16*b*, 18 may be determined by their respective functions. For example, in many applications, a third member 18 may comprise the portion of a shackle 14 that passes through one or more items being secured. Accordingly, since many apertures engaged by a padlock 10 are circular, a third member 18 may have a circular cross-section (e.g., have a generally cylindrical shape). Alternative, or in addition thereto, one of the other members 16*a*, 16*b* may comprise the portion of a shackle 14 that passes through one or more items being secured. Accordingly, one or both of the other members 16*a*, 16*b* may also have a circular cross-section or a generally cylindrical shape.

The various components of a lock 10 in accordance with the present invention may be formed of any suitable materials. Suitable materials may be selected to provide a desired durability, strength, rigidity, toughness, or the like. For example, in selected embodiments, one or more of the components of a lock 10 may be formed of a polymer material. However, in other embodiments where greater stresses are expected, such components may be formed of a metal or metal alloy.

Figure 2:
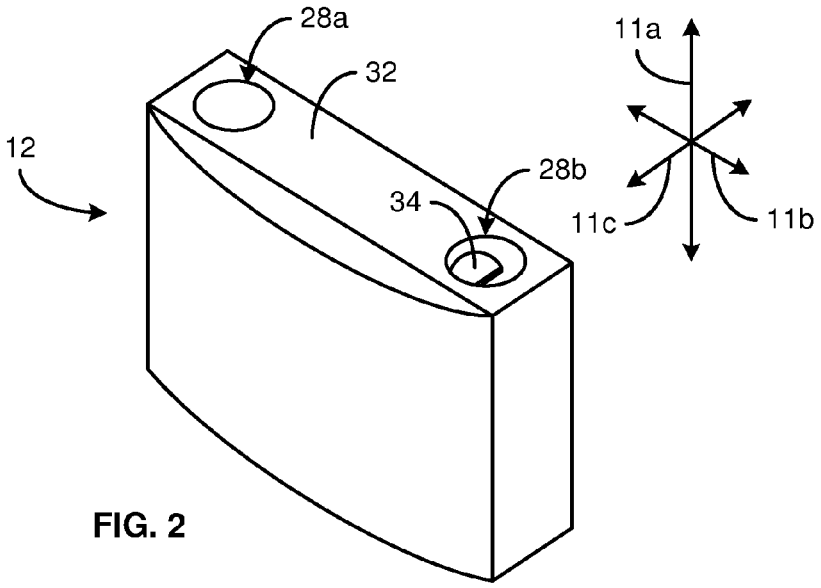
FIG. 2 is a perspective view of an alternative embodiment of a base suitable for use in connection with a shackle in accordance with the present invention.
Figure 3:
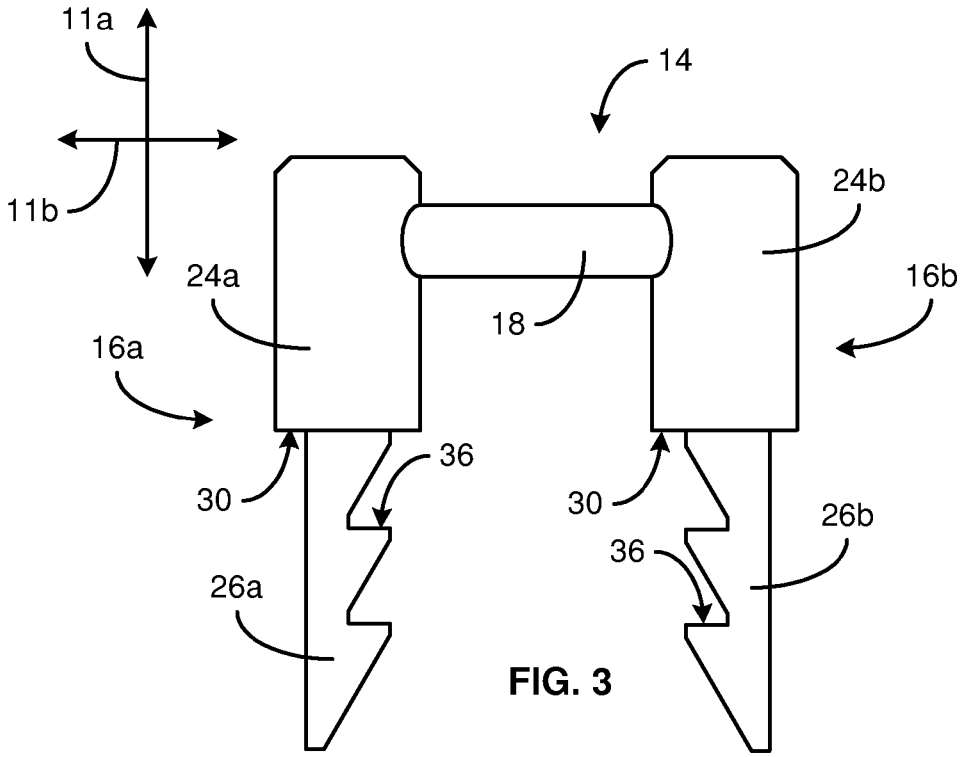
FIG. 3 is a front elevation view of one embodiment of a shackle in accordance with the present invention.
Figure 4:
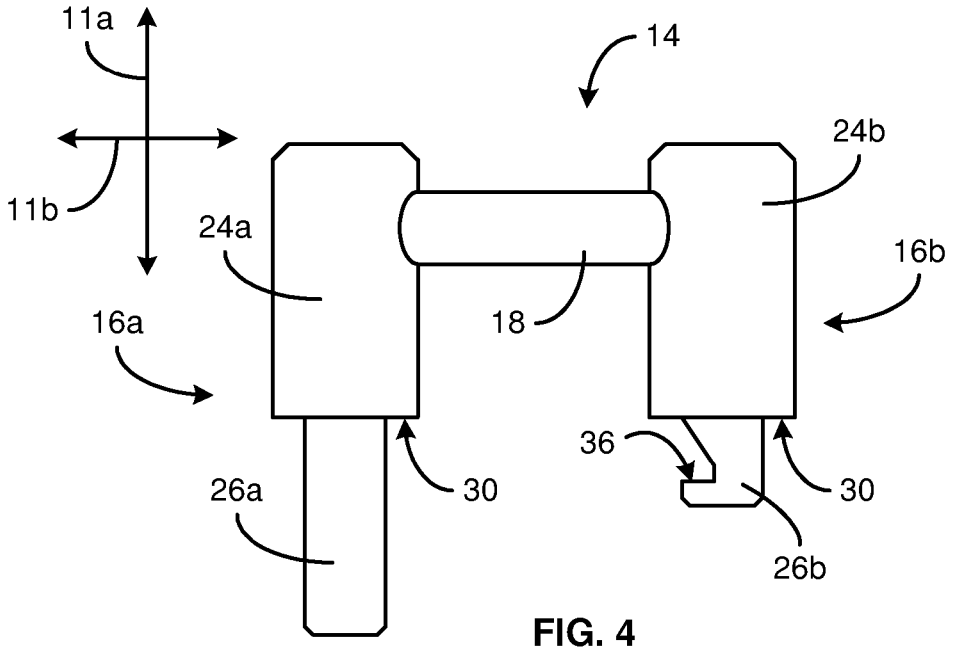
FIG. 4 is a front elevation view of another embodiment of a shackle in accordance with the present invention.
Figure 5:
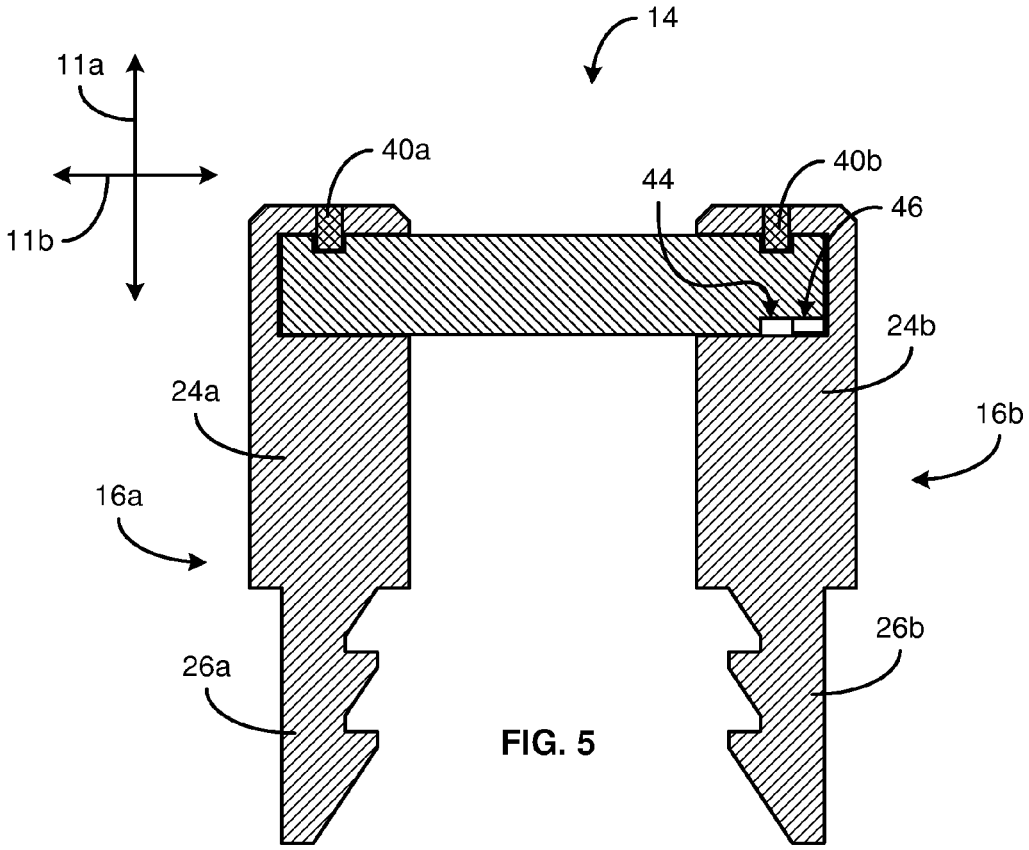
FIG. 5 is a front, cross-sectional view of one embodiment of a shackle in accordance with the present invention, the shackle comprising a horizontal member permanently engaging one vertical member and selectively locking with the other vertical member.
Figure 6:
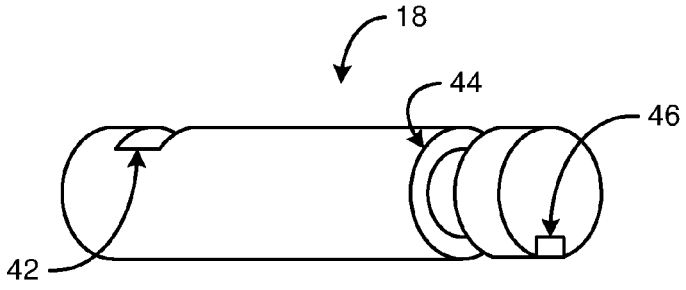
FIG. 6 is a perspective view of the horizontal member of FIG. 5.
Figure 7:
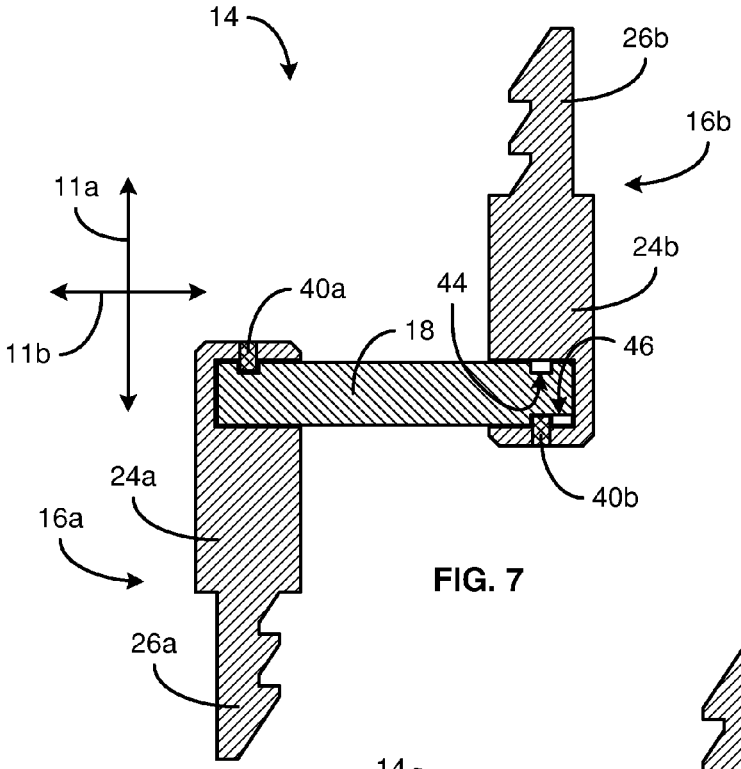
FIG. 7 is a front, cross-sectional view of the shackle of FIG. 5 with one vertical member rotated to an aligned position.
Figure 8:
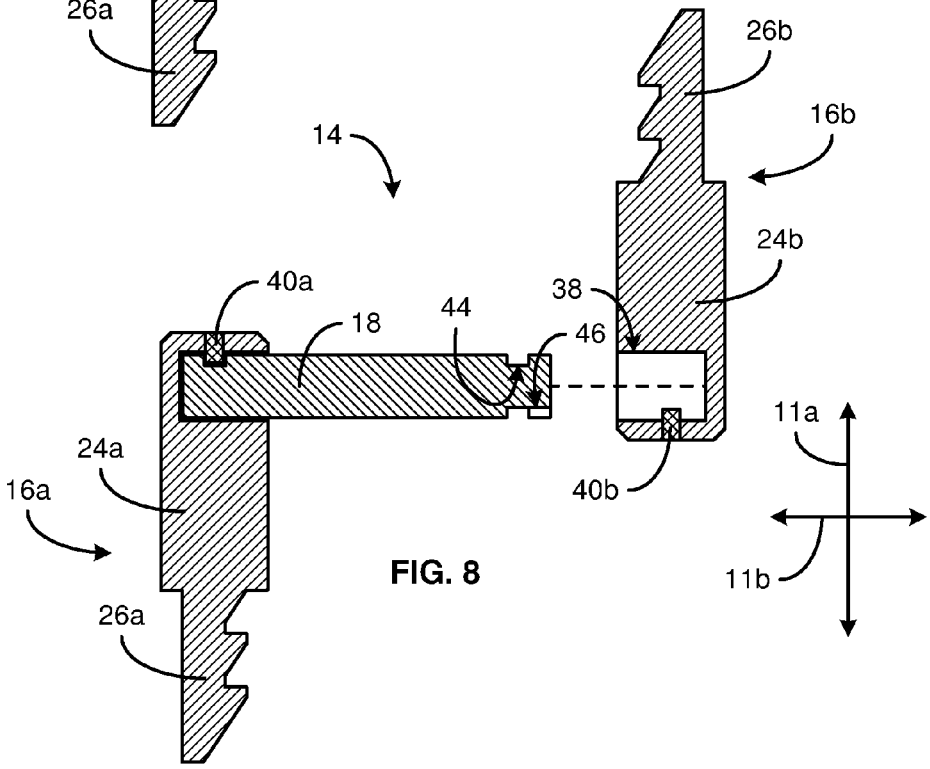
FIG. 8 is a front, cross-sectional view of the shackle of FIG. 5 with one vertical member removed from the horizontal member.

Referring to FIGS. 2-4, in selected embodiments, each vertical member 16*a*, 16*b* of a shackle 14 may include both a post or exterior portion 24*a*, 24*b* and an anchor or interior portion 26*a*, 26*b*. When a lock 10 in accordance with the present invention is fully assembled and locked, the exterior portions 24*a*, 24*b* of the vertical members 16*a*, 16*b* may be positioned outside a corresponding base 12, while the interior portions 26*a*, 26*b* may be received within corresponding apertures 28*a*, 28*b* formed within the base 12. A shoulder 30 may mark the boundary between an exterior portion 24*a*, 24*b* and a corresponding interior portion 26*a*, 26*b*. A shoulder 30 may abut against a top surface 32 of a base 12 when a lock 10 is fully assembled and locked.

An exterior portion 24*a*, 24*b* may be connected to a corresponding interior portion 26*a*, 26*b* in any suitable manner. For example, in selected embodiments, an interior portion 26*a*, 26*b* may be a monolithic extension of a corresponding exterior portion 24*a*, 24*b*. That is, the exterior and interior portions 24*a*, 24*b*, 26*a*, 26*b* may be machined, cast, or otherwise formed of a single continuous and seamless piece of material. Alternatively, exterior portions 24*a*, 24*b* may be connected to corresponding interior portions 26*a*, 26*b* through the use of swaging, interference fits, threads, welds, bonding agents, fasteners, keyways, or the like or combinations thereof.

A latching mechanism of a base 12 may include one or more latches 34 configured to engage corresponding structures 36 or apertures 36 of the interior portions 26*a*, 26*b* to directly secure one or both of the interior portions 26*a*, 26*b* with the apertures 28*a*, 28*b*. Accordingly, the interior portions 26*a*, 26*b* of one or both vertical members 16*a*, 16*b* may include one or more of such structures 36 or apertures 36. In selected embodiments, the interior portions 26*a*, 26*b* of the vertical members 16*a*, 16*b* may be substantially identical (e.g., mirror images of one another). For example, either vertical members 16*a*, 16*b* may be inserted within either aperture 28*a*, 28*b*. Alternatively, each of the interior portions 26*a*, 26*b* may configured differently to provide or support specific functionality corresponding thereto.

In certain embodiments, once released by a latching mechanism, an entire shackle 14 may be removed from a corresponding base 12. In other embodiments (see e.g., FIG. 4), one interior portion (e.g., interior portion 26*a*) may be retained at least partially within a base 12 and function as a pivot for the shackle 14. Accordingly, a shackle 14 may translate, pivot, or the like with respect to a base 12 in any suitable or conventional manner.

Referring to FIGS. 5-8, a horizontal member 18 may engage respective vertical members 16*a*, 16*b* in any suitable manner. In certain embodiments, each exterior portion 24*a*, 24*b* of each vertical member 16*a*, 16*b* may include an aperture 38 (e.g., a lateral aperture 38 or an aperture 38 extending in the lateral direction 11*b*) for receiving a corresponding end of a horizontal member 18. An end of a horizontal member 18 may engage a corresponding aperture 38 with any one of a slip fit, locking engagement, permanent engagement, or the like.

For example, in the illustrated embodiment, one end of the horizontal member 18 engages one vertical member 16*a* with a substantially permanent engagement and the other vertical member 16*b* with a selectively locking engagement. A permanent engagement between a horizontal member 18 and a vertical member 16*a* may be accomplished in any suitable manner. A permanent engagement may employ monolithic formation (e.g., machining an exterior portion 24*a*, 24*b* and horizontal member 18 from a single continuous and seamless piece of material), swaging, interference fits, threads, welds, bonding agents, fasteners (e.g., pins, keys, screws, bolts), keyways (e.g. grooves, flats), or the like or combinations thereof. For example, in the illustrated embodiment, a substantially permanent engagement comprises a fixed or permanent extension 40*a* (e.g., pin 40*a*) extending to engage a groove 42 formed in a corresponding end of the horizontal member 18 and resist removal of the horizontal member 18 from the corresponding vertical member 16*a*.

A locking engagement between a horizontal member 18 and a vertical member 16*b* may be accomplished in any suitable manner. A locking engagement may employ threads, fasteners (e.g., pins, keys, screws, bolts), keyways (e.g. grooves, flats), or the like or combinations thereof. For example, in the illustrated embodiment, one end of a horizontal member 18 may include a circumferential groove 44 and a lateral groove 46. A circumferential groove 44 may extend circumferentially about a horizontal member 18 proximate one end. A lateral groove 46 may extend in the lateral direction 11*b* from a circumferential groove 44 to a proximate end of the horizontal member 18. A locking engagement may comprise a fixed or permanent extension 40*b* (e.g., pin 40*b*) extending to engage the circumferential groove 44, while the lateral groove 46 may provide a location for the extension 40*b* to exit the circumferential groove 44 when desired.

That is, when a shackle 14 is locked with respect to a base 12, an extension 40*b* and circumferential groove 44 may interact to effectively lock a horizontal member 18 to a corresponding vertical member 16*b*. This locking may improve the strength of the securement provided by the lock 10, making it more resistant to tampering (e.g., prying).

However, when the vertical member 16*b* is released from the base 12, the vertical member 16*b* may pivot about the corresponding end of the horizontal member 18 (e.g., rotate about an axis extending parallel to the lateral direction 11*b*) until the extension 40*b* is aligned with the lateral groove 46. At this location of alignment, the extension 40*b* may pass, via the lateral groove 46, out of the circumferential groove 44 and the vertical member 16*a* may separate from the horizontal member 18. In selected embodiments, a lateral groove 46 may be located opposite (e.g., 180 degrees of rotation from) the extension 40*b* when the shackle 14 is locked with respect to a corresponding base 12.

Accordingly, in operation, a user may release (e.g., with a key, combination, or the like) a latching mechanism and free a shackle 14 from a base 12. With a vertical member 16*b* free to move with respect to the base 12, the vertical member 16*b* may be rotated about the corresponding end of the horizontal member 18 until the extension 40*b* is aligned with the lateral groove 46. The extension 40*b* may then travel along the lateral groove 46 as the user pulls the vertical member 16*b* off the end of the horizontal member 18.

Once one or more items have been engaged by a shackle 14 or removed therefrom, the shackle 14 may be reassembled and locked with respect to a base 12. This may be accomplished by aligning the extension 40*b* with the lateral groove 46 and then advancing the end of the horizontal member 18 into the lateral aperture 38 in the corresponding vertical member 16*b*. When the extension 40*b* reaches the circumferential groove 44, the vertical member 16*b* may be rotated about the end of the horizontal member 18 until the shackle 14 is ready to be inserted into the base 12. As the shackle 14 is inserted into the base 12, it may be engaged and secured by a latching mechanism. In this locked configuration, the extension 40*b* and circumferential groove 44 may interact to bind the vertical and horizontal members 16*a*, 18 together.

Figure 9:
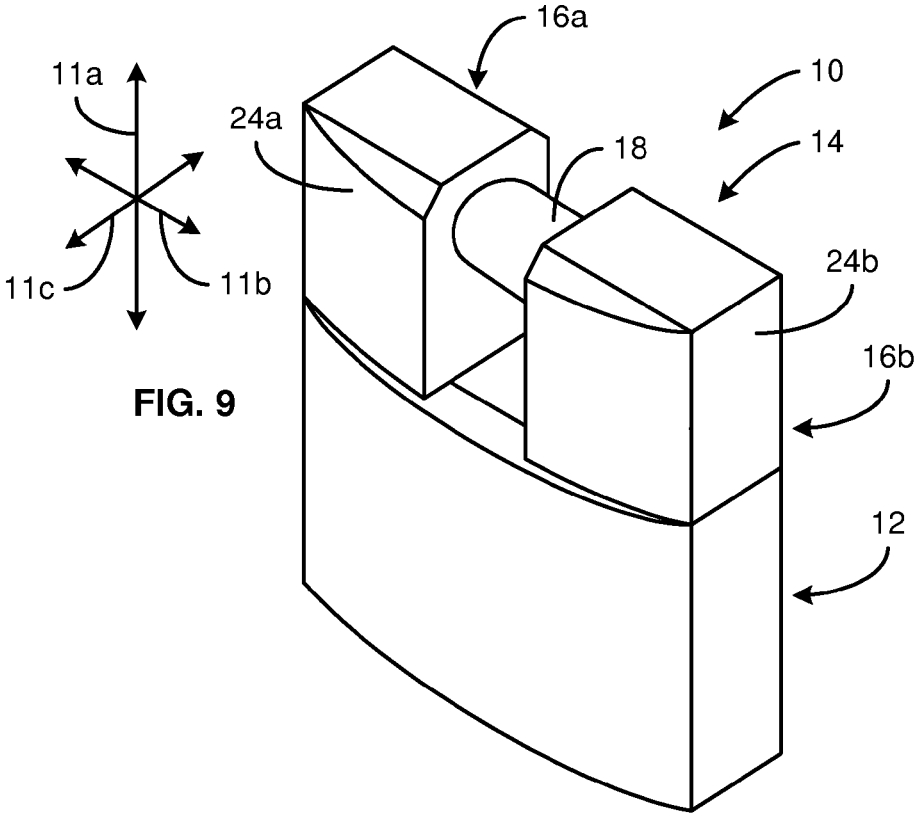
FIG. 9 is a perspective view of another embodiment of a padlock in accordance with the present invention, the padlock comprising a shackle secured to the base of FIG. 2, the shackle comprising first and second vertical members configured to match the shape and design of the base.
Figure 10:
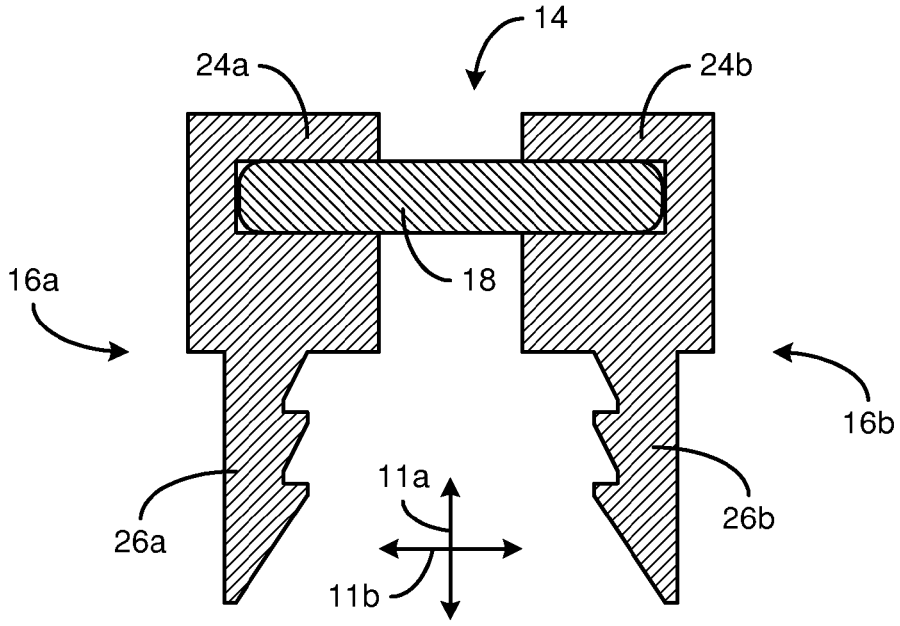
FIG. 10 is a cross-sectional view of one possible embodiment of the shackle of FIG. 9.

Referring to FIGS. 9 and 10, one or more members 16*a*, 16*b*, 18 of a shackle 14 or portions 24*a*, 24*b*, 26*a*, 26*b* thereof may have a non-cylindrical shape. In selected embodiments, the shapes utilized may provide a desired aesthetic, increased strength, reduced space for tampering (e.g., cutting, prying), or the like or some combination thereof.

For example, a base 12 may have a particular geometry, profile, or design. Accordingly, as shown in the illustrated embodiment, one or both exterior portions 24*a*, 24*b* of corresponding vertical members 16*a*, 16*b* may be shaped to match (e.g., form an extension of or complement to) the geometry, profile, or design of the base 12. This may improve the aesthetic of the lock 10, improve the strength of the vertical members 16*a*, 16*b*, reduce the length of the horizontal member 18 exposed to cutting or prying, or the like or some combination thereof.

Figure 11:
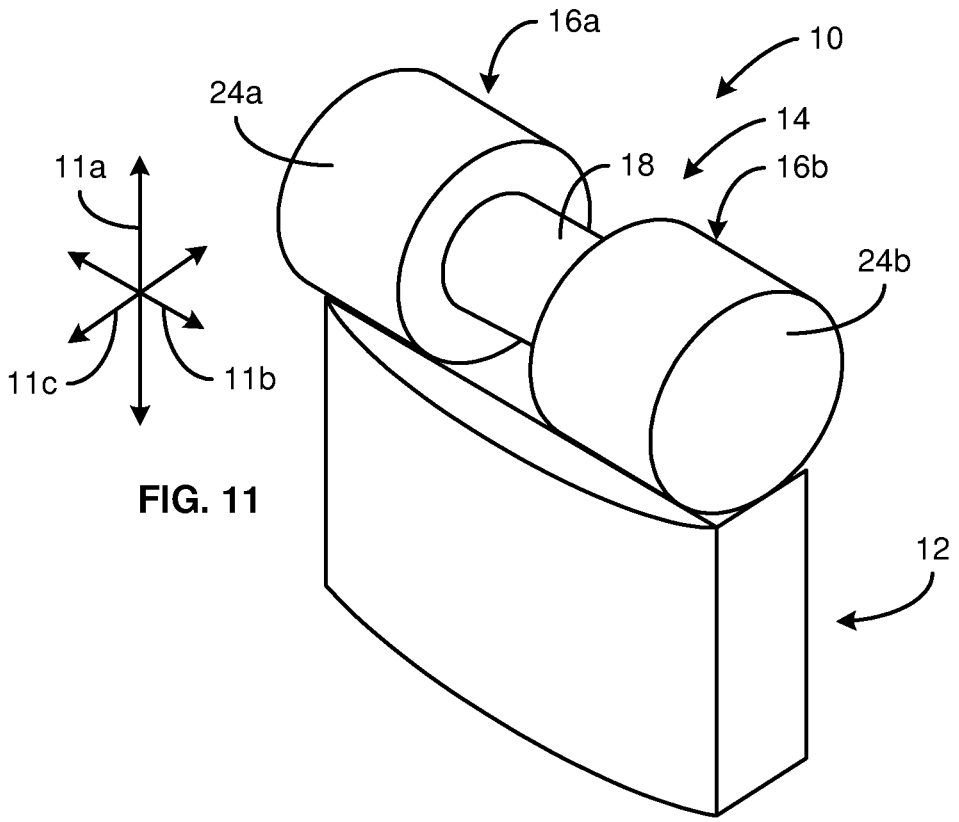
FIG. 11 is a perspective view of another embodiment of a padlock in accordance with the present invention, the padlock comprising a shackle secured to the base of FIG. 2, the shackle comprising two exterior portions configured as laterally extending cylinders.
Figure 12:
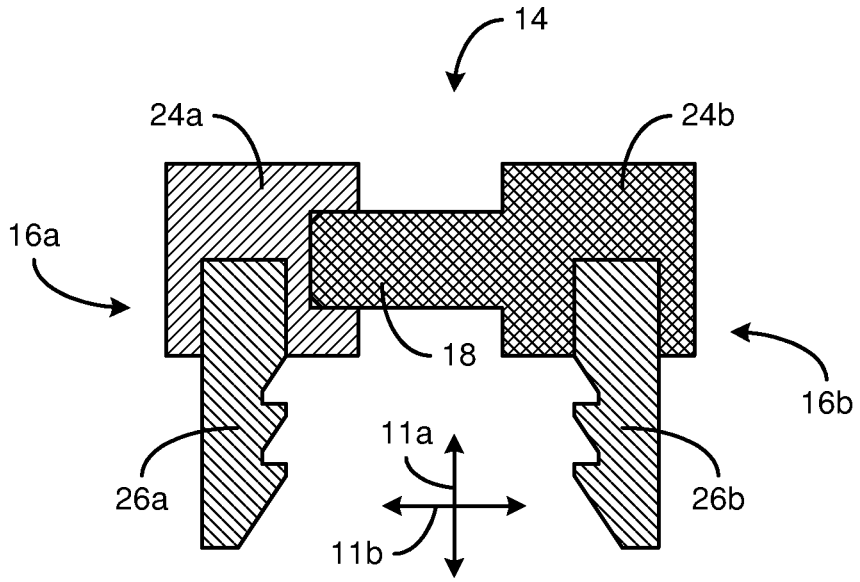
FIG. 12 is a cross-sectional view of one possible embodiment of the shackle of FIG. 11.

Referring to FIGS. 11 and 12, in selected embodiments, one or more vertical members 16*a*, 16*b*, 18 of a shackle 14 or portions 24*a*, 24*b*, 26*a*, 26*b* thereof may have a cylindrical shape aligned with a direction other than the longitudinal direction 11*a*. For example, one or more exterior portions 24*a*, 24*b* of a shackle 14 may comprise a cylindrical section extending parallel with the lateral direction 11*b*.

Figure 13:
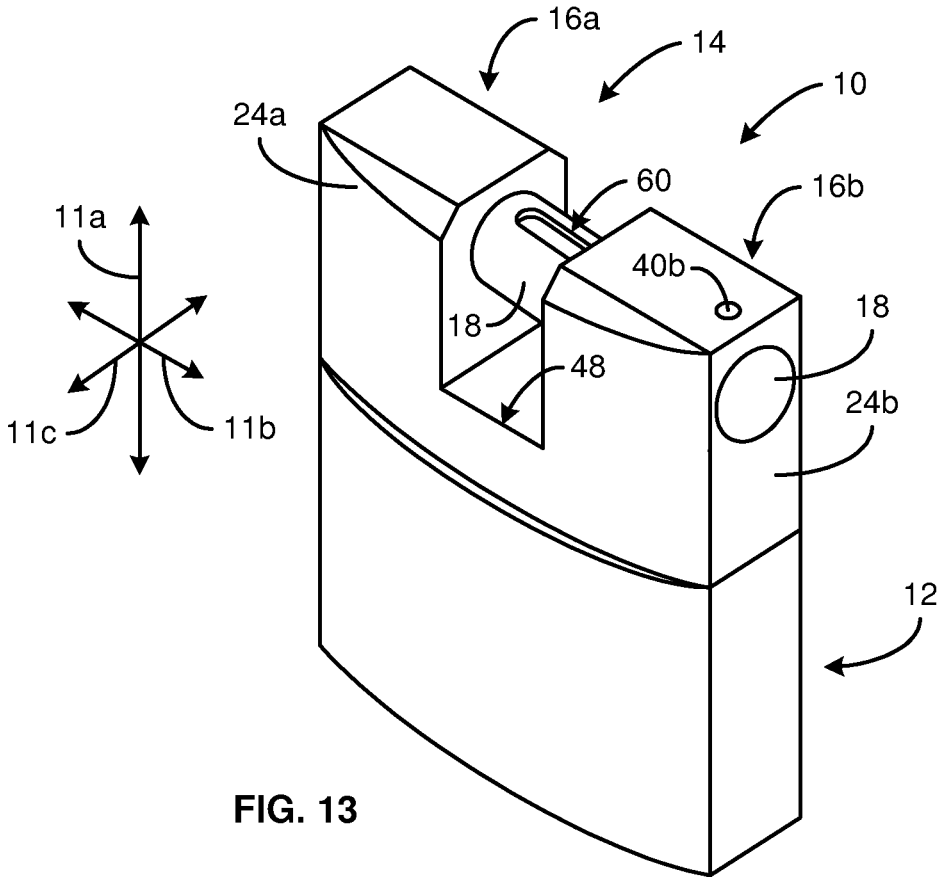
FIG. 13 is a perspective view of another embodiment of a padlock in accordance with the present invention, the padlock comprising a shackle secured to the base of FIG. 2, the shackle comprising first and second vertical members joined together and configured to match the shape and design of the base.
Figure 14:
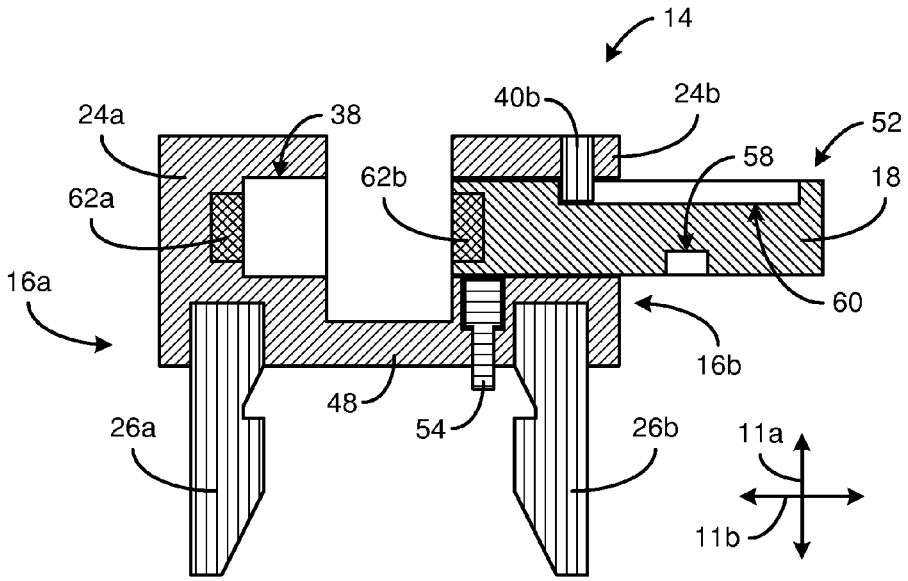
FIG. 14 is a cross-sectional view of one possible embodiment of the shackle of FIG. 13, the shackle having the horizontal member in an open configuration.
Figure 15:
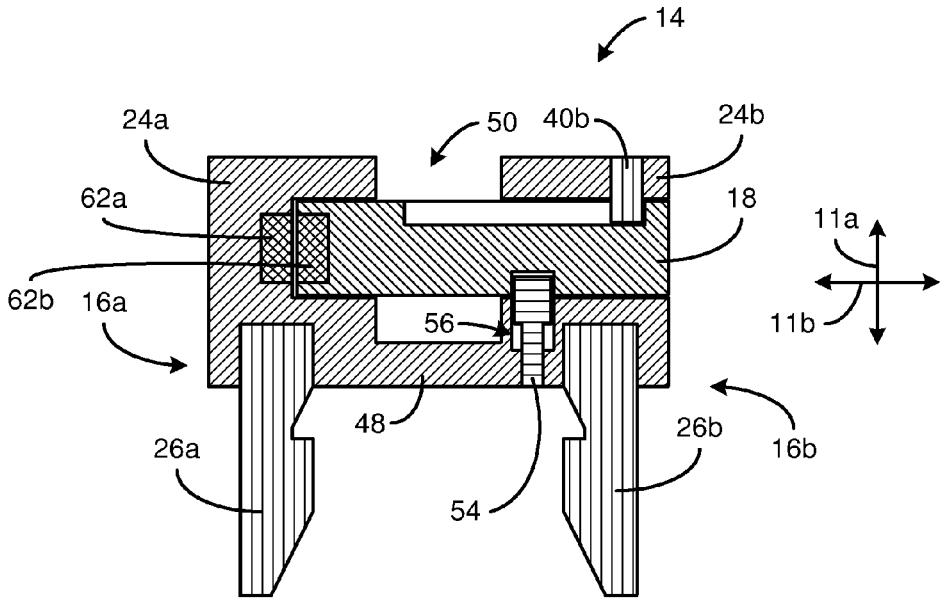
FIG. 15 is a cross-sectional view of the shackle of FIG. 14 with the horizontal member in a closed configuration.

Referring to FIGS. 13-15, in certain embodiments, an exterior portion 24*a* of one vertical member 16*a* may directly connect to an exterior portion 24*b* of another vertical member 16*b*. For example, a bridge 48 may extend to connect one exterior portion 24*a* to another exterior portion 24*b*. A first exterior portion 24*a*, second exterior portion 24*b*, and bridge 48 may be monolithically formed (e.g., machined) from a single piece of material. If desired, a first exterior portion 24*a*, second exterior portion 24*b*, and bridge 48 may match the geometry, profile, or design of a corresponding base 12.

In selected embodiments, a horizontal member 18 may be configured to selectively move with respect to the rest of a shackle 14. For example, a horizontal member 18 may selectively translate in the lateral direction 11*b* between a closed position 50 and an open position 52. A shackle 14 may include a latch selectively securing the horizontal member 18 in the closed position.

For example, a shackle 14 may include an interference member 54 selectively traveling (e.g., translating) within an aperture 56 (e.g., an aperture 56 formed within an exterior portion 24*b* of a vertical member 16*b*). When aligned with and inserted within a corresponding interference aperture 58 formed in a horizontal member 18, an interference member 54 may lock the horizontal member 18 in a closed position 50.

In certain embodiments, an interference member 54 may, when not aligned with an interference aperture 58, extending from a corresponding exterior portion 24*b*. This extension may prevent the shackle 14 from fully engaging a base 12. Accordingly, the shackle 14 may be prevented from engaging a base 12 when the horizontal member 18 is not properly secured in the closed position 50.

Additionally, when a horizontal member 18 is in the closed position 50, an interference members 54 is aligned with and inserted within a corresponding interference aperture 58, and the shackle 14 is locked to a base 12, the base 12 (e.g., a top surface 32 of the base 12) may block the interference member 54 from exiting the interference aperture 58. This may lock the horizontal member 18 in the closed position 50. Accordingly, the horizontal member 18 may transition to an open position 52 only when the shackle 14 has been released by the base 12.

In selected embodiments, an extension 40*b* may control or limit the motion of a horizontal member 18 with respect to a particular exterior portion 14*b*. For example, a horizontal member 18 may include a slot 60 extending in the lateral direction 11*b*. An extension 40*b* may extending into the slot 60. Interference or abutment between the extension 40*b* and the borders of the slot 60 may define the permissible motion of the horizontal member 18 with respect to the exterior portion 24*b*. For example, contact between an extension 40*b* and the sides of a slot 60 may resist rotation of a horizontal member 18 with respect to a corresponding exterior portion 24*b*. Similarly, contact between an extension 40*b* and an end of the slot 60 may resist separation of a horizontal member 18 from a corresponding exterior portion 24*b*.

A shackle 14 may include a biasing mechanism biasing a horizontal member 18 toward or away from one position 50 or another 52. For example, a biasing mechanism may comprise a spring (e.g., coil spring) positioned within a lateral aperture 38 and biasing a horizontal member 18 away from a closed position 50, thereby facilitating a transition of the horizontal member 18 to an open position 52. Alternatively, a biasing mechanism may comprise two magnets 62*a*, 62*b*. One magnet 62*a* may be positioned within a lateral aperture 38. The other magnet 62*b* may be positioned in a corresponding end of a horizontal member 18. By orienting the magnets 62*a*, 62*b* to repel one another, a horizontal member 18 may be biased away from the closed position 50. Conversely, by orienting the magnets 62*a*, 62*b* to attract one another, a horizontal member 18 may be biased toward the closed position 50.

Figure 16:
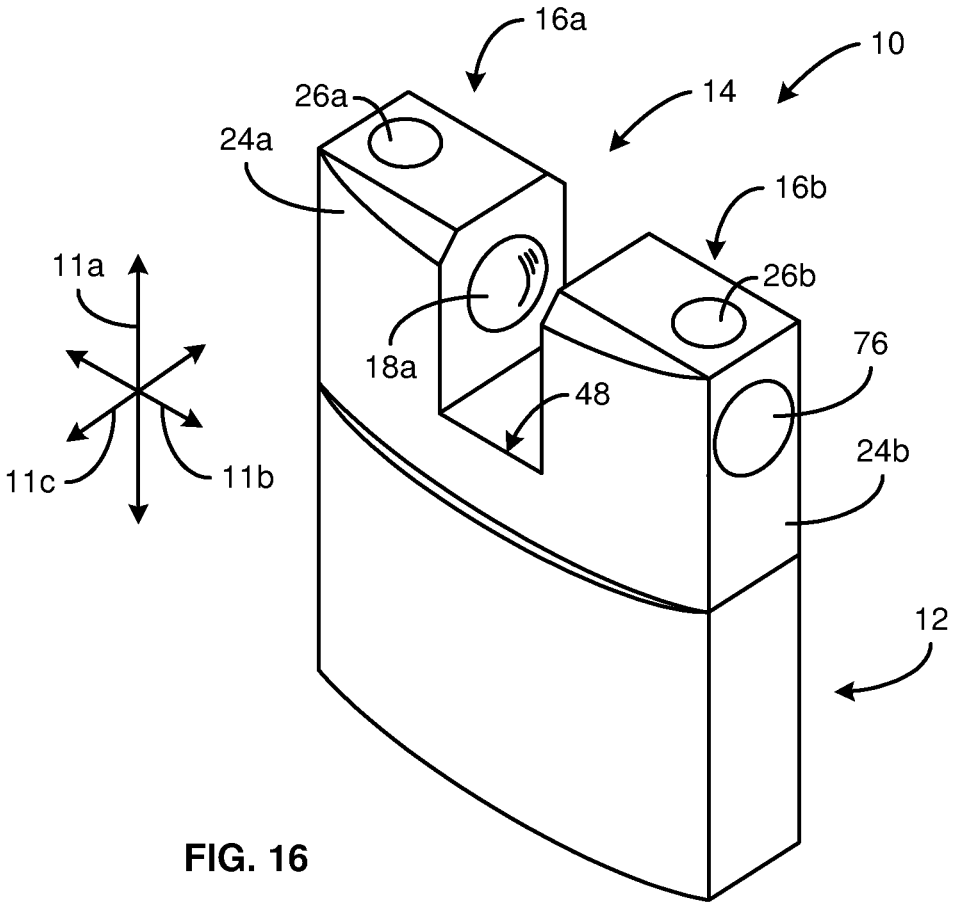
FIG. 16 is a perspective view of another embodiment of a padlock in accordance with the present invention, the padlock comprising a shackle secured to the base of FIG. 2, the shackle having a horizontal member comprising separate elements.
Figure 17:
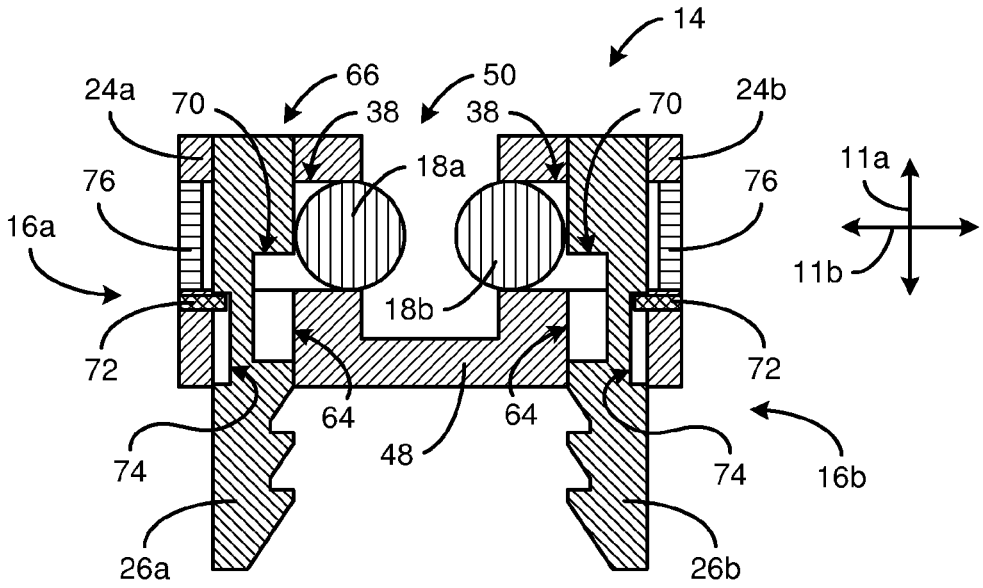
FIG. 17 is a cross-sectional view of one possible embodiment of the shackle of FIG. 16, the shackle having the elements of the horizontal member in a closed or locked configuration.
Figure 18:
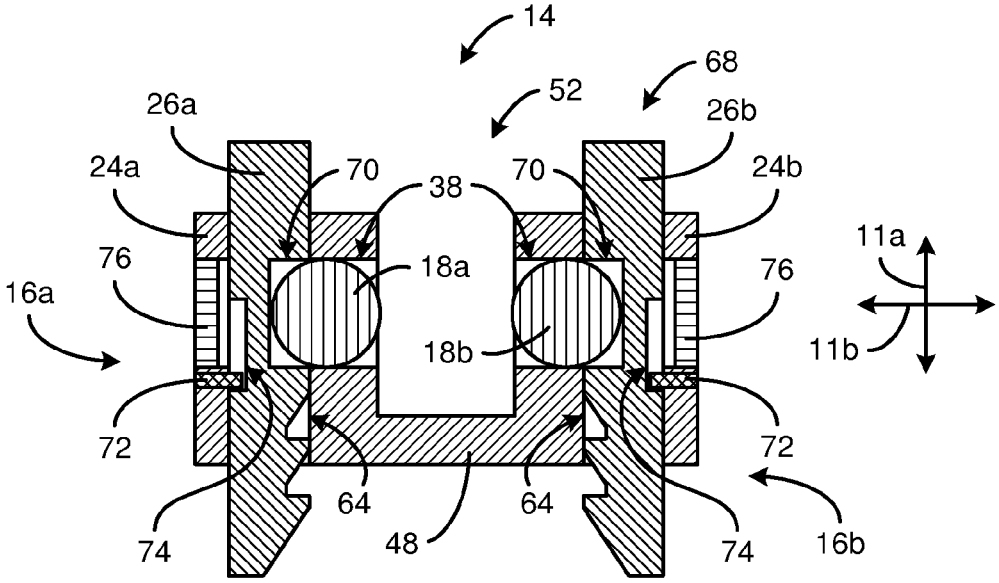
FIG. 18 is a cross-sectional view of the shackle of FIG. 16 with the elements of the horizontal member in an open or unlocked configuration.
Figure 19:
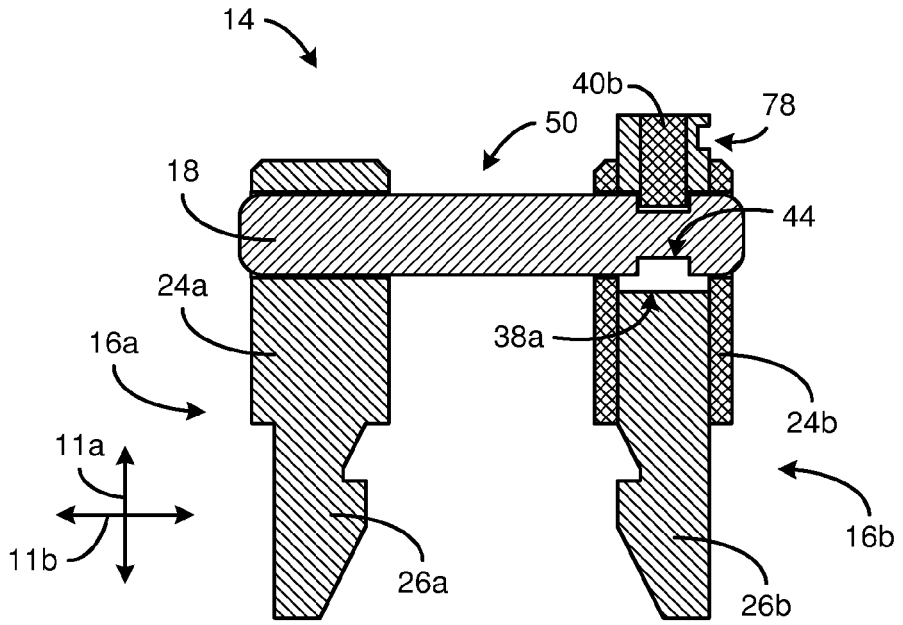
FIG. 19 is a cross-sectional view of another embodiment of a shackle in accordance with the present invention, the shackle comprising a horizontal member in a closed configuration.
Figure 20:
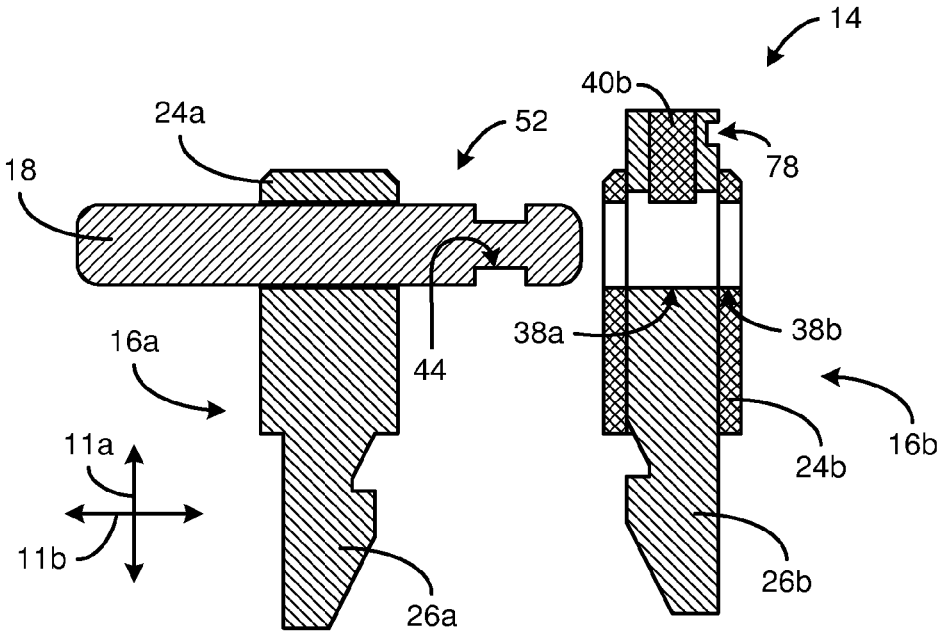
FIG. 20 is a cross-sectional view of the shackle of FIG. 19 with the horizontal member in an open configuration.
Figure 21:
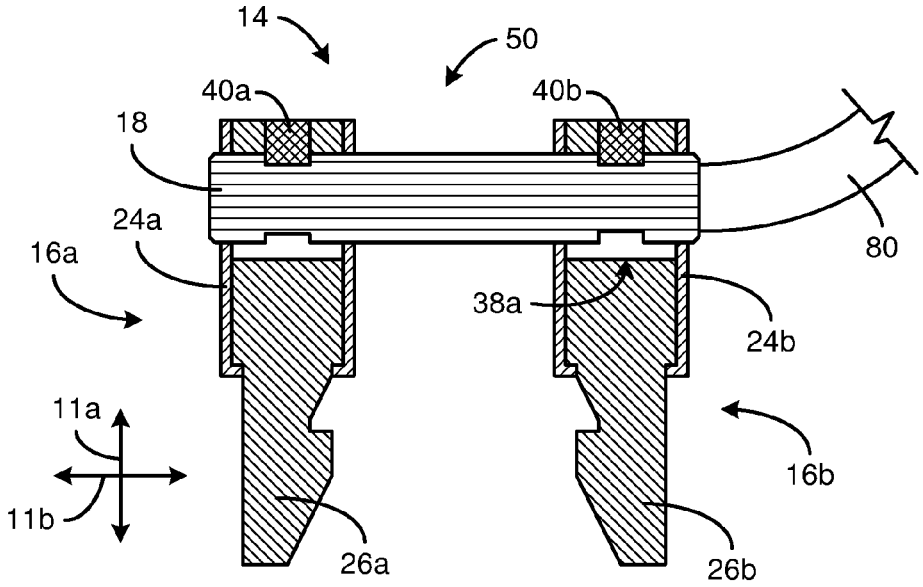
FIG. 21 is a cross-sectional view of another embodiment of a shackle in accordance with the present invention, the shackle comprising a horizontal member in a closed configuration and connected to a tether.
Figure 22:
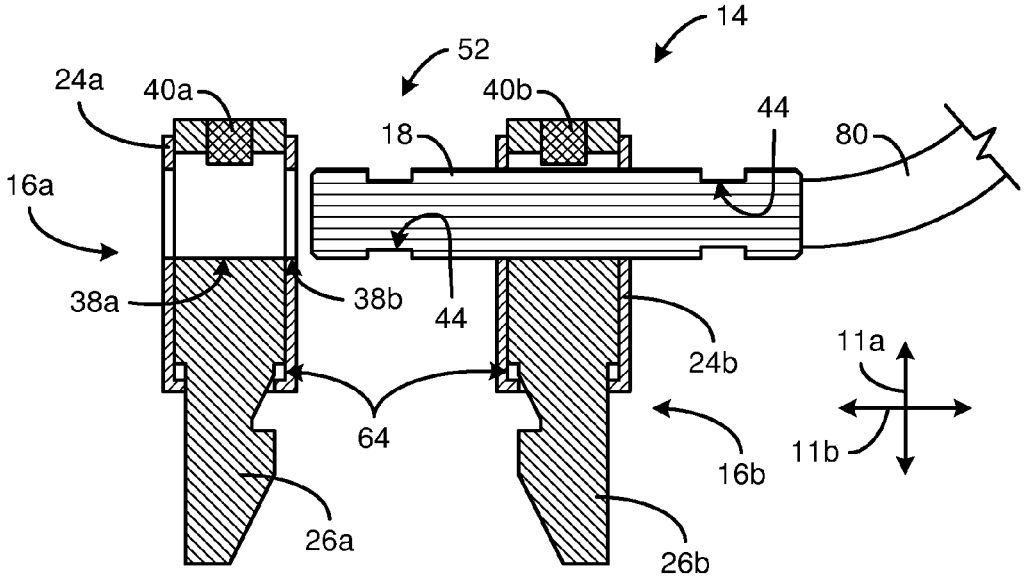
FIG. 22 is a cross-sectional view of the shackle of FIG. 21 with the horizontal member in an open configuration.
Figure 23:
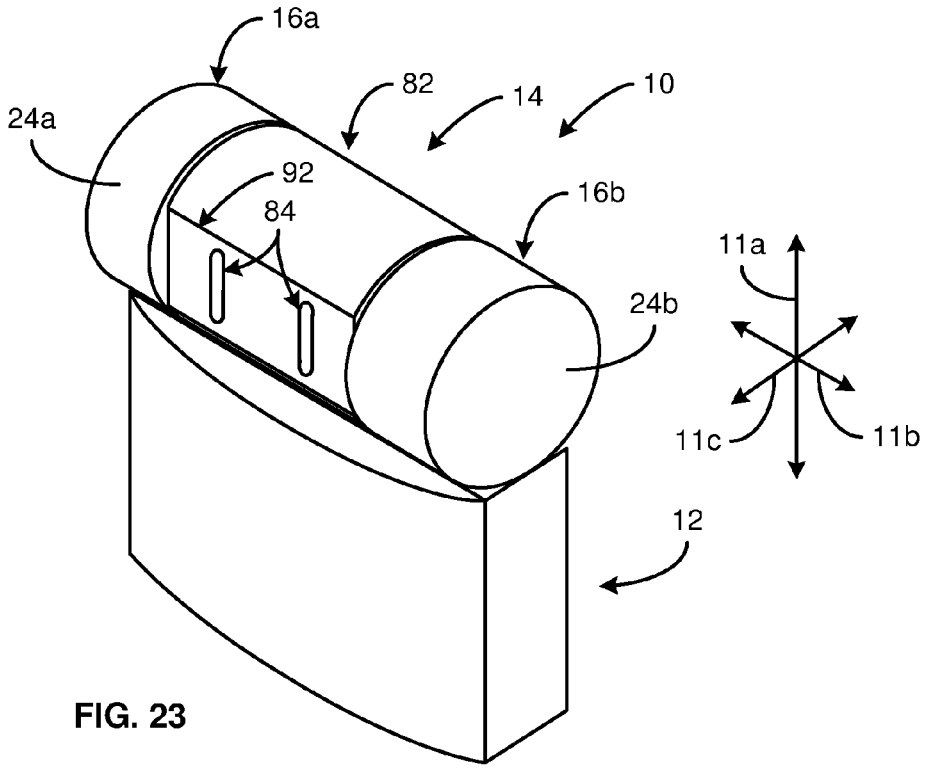
FIG. 23 is a perspective view of another embodiment of a padlock in accordance with the present invention, the padlock comprising a shackle secured to the base of FIG. 2, the shackle comprising an interface configured to receive and secure an electrical plug.
Figure 24:
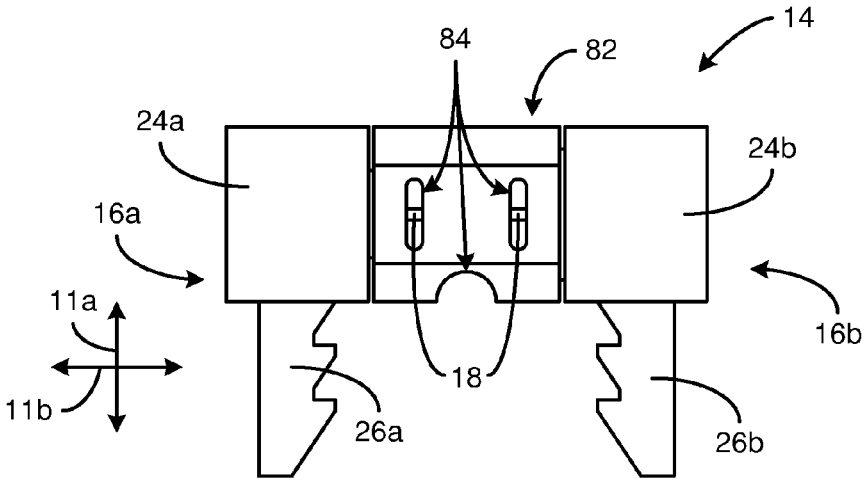
FIG. 24 is a front elevation view of the shackle of FIG. 23.
Figure 25:
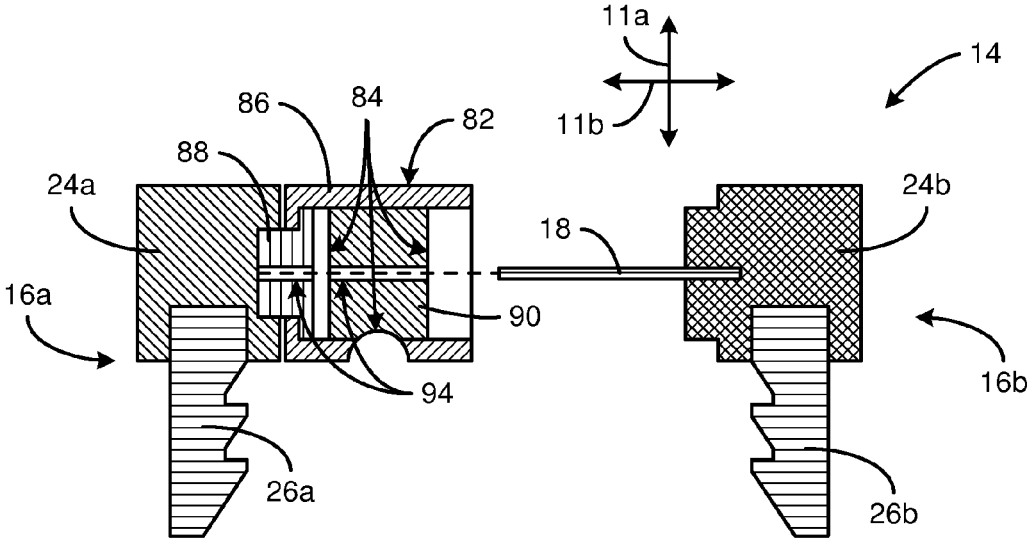
FIG. 25 is a cross-sectional view of one possible embodiment of the shackle of FIG. 23 with the horizontal member in an open or unlock configuration.
Figure 26:
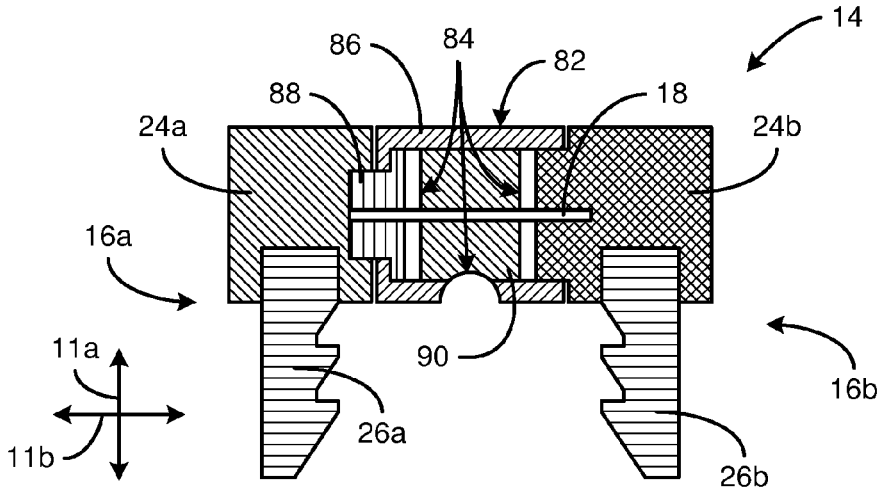
FIG. 26 is a cross-sectional view of the shackle of FIG. 25 with the horizontal member in an open configuration.

Referring to FIGS. 16-18, in selected embodiments, a horizontal member 18 may comprise separable elements 18*a*, 18*b*. Depending on the application to which a lock 10 is to be applied, the separable elements 18*a*, 18*b* may meet or abut in a closed position 50. Alternatively, the elements 18*a*, 18*b* may not meet or abut when in a closed position 50. For example, in selected embodiments, a horizontal member 18 may comprise a first ball 18*a* (e.g., metal ball suitable for use in a ball bearing), corresponding to one vertical member 16*a*, and a second ball 18*b*, corresponding to another vertical member 16*b*, spaced some distance from one another in the closed position 50.

A vertical member 16*a*, 16*b* or portion thereof may be configured to selectively move with respect to the rest of a shackle 14. For example, one or more interior portions 26*a*, 26*b* may be configured to selectively travel (e.g., translate) within an aperture 64 formed within a corresponding exterior portion 24*a*, 24*b*. In selected embodiments, this motion of an interior portion 26*a*, 26*b* with respect to a corresponding exterior portion 24*a*, 24*b* may provide a mechanism for securing a horizontal member 18 or elements thereof 18*a*, 18*b* in place (e.g., in a closed position 50).

For example, an interior portion 26*a*, 26*b* may selectively move through a range of motion within a corresponding aperture 64. In selected embodiments, a range of motion of an interior portion 26*a*, 26*b* may include a blocking portion and a non-blocking portion. A blocking portion may include one or more blocking positions 66 of an interior portion 26*a*, 26*b*. A non-blocking portion may include one or more non-blocking positions 68 of an interior portion 26*a*, 26*b*.

That is, a shackle 14 may include one or more elements 18*a*, 18*b* (e.g., balls 18*a*, 18*b*) corresponding to a horizontal member 18. Each lateral aperture 38 may contain, or partially contain, a corresponding element 18*a*, 18*b*. Each element 18*a*, 18*b* may extend from a corresponding lateral aperture 38 to engage an item to be secured by the lock 10.

In a blocking position 66, an interior portion 26*a*, 26*b* may block a horizontal member 18 or element 18*a*, 18*b* thereof from moving out of engagement with an item. Conversely, in a non-blocking position 66, a recess 70, aperture 70, or the like of an interior portion 26*a*, 26*b* may permit a horizontal member 18 or element 18*a*, 18*b* thereof to move within a corresponding lateral aperture 38. Accordingly, with an interior portion 26*a*, 26*b* in a non-blocking position 68, a horizontal member 18 or element 18*a*, 18*b* thereof may move out of engagement with an item.

By engaging one or more interior portions 26*a*, 26*b*, a base 12 may control or limit the motion of the one or more interior portions 26*a*, 26*b* with respect to the rest of a shackle 14. Accordingly, a base 12 may secure or lock one or more interior portions 26*a*, 26*b* in their respective blocking positions 66. Thus, when a shackle 12 is locked by a base 12, a horizontal member 18 or the elements 18*a*, 18*b* thereof may be locked in an closed position 66 (e.g., an extended, deployed, or engaged position).

With an interior portion 26*a*, 26*b* blocking one end of a lateral aperture 38, the other end of the lateral aperture 38 may include one or more constrictions to prevent a corresponding element 18*a*, 18*b* from completely exiting the aperture 38. One or more constrictions may be formed in an initial machining process, casting process, molding process, or the like. Alternatively, or in addition thereto, one or more constrictions may be formed or installed in an assembly process.

For example, in selected embodiments, after an element 18*a*, 18*b* has been placed within a corresponding lateral aperture 38, a locking ring may be installed to form a constriction preventing inadvertent removal of the element 18*a*, 18*b* from the lateral aperture 38. Alternatively, after an element 18*a*, 18*b* has been placed within a lateral aperture 38, a portion (e.g., an opening) of the lateral aperture 38 may be swaged or otherwise deformed to form a constriction preventing inadvertent removal of the element 18*a*, 18*b*.

In selected embodiments, an extension 72 (e.g., pin 72) may control or limit the motion of an interior portion 26*a*, 26*b* with respect to a corresponding exterior portion 24*a*, 24*b*. For example, an interior portion 26*a*, 26*b* may include a slot 74 extending in the longitudinal direction 11*a*. An extension 72 may extending into the slot 74. Interference or abutment between the extension 72 and the borders of the slot 72 may define the permissible motion of the interior portion 26*a*, 26*b* with respect to the exterior portion 24*a*, 24*b*. For example, contact between an extension 72 and the sides of a slot 74 may resist rotation of an interior portion 26*a*, 26*b* with respect to a corresponding exterior portion 24*a*, 24*b*. Similarly, contact between an extension 72 and an end of the slot 74 may resist separation of an interior portion 26*a*, 26*b* from a corresponding exterior portion 24*a*, 24*b*.

A shackle 14 in accordance with the present invention may include various apertures or openings to enable or facilitate manufacture, assembly, or some combination thereof. After manufacture or assembly, certain such apertures or openings may be unnecessary or undesirable. Accordingly, such apertures or openings may be closed. For example, certain such apertures may be closed with a plug 76. A plug 76 may engage a corresponding aperture or opening with a permanent engagement.

Referring to FIGS. 19-22, in selected embodiments, one or more vertical members 16*a*, 16*b* may include an exterior portion 24*a*, 24*b* configured as a sleeve selectively moving with respect to a core comprising a corresponding interior portion 26*a*, 26*b*. On the one or more vertical members 16*a*, 16*b* so configured, both the exterior and interior portions 24*a*, 24*b*, 26*a*, 26*b* may include lateral apertures 38. However, the lateral apertures 38*a* corresponding to the interior portions 26*a*, 26*b* may be oversized (e.g., elongated), while the lateral apertures 38*b* corresponding to the exterior portions 24*a*, 24*b* may not be so sized.

An extension 40*a*, 40*b* may extend into an aperture 38*a* formed in an interior portion 26*a*, 26*b*. When an end of a horizontal member 18 is biased to a first end of such an aperture 38*a*, the extension 40*a*, 40*b* may engage a groove 44 (e.g., circumferential groove 44) formed proximate that end. Conversely, when an end of a horizontal member 18 is biased to a second, opposite end of such an aperture 38*a*, the extension 40*a*, 40*b* may not reach the groove 44. Accordingly, when biased to the second end, the horizontal member 18 may be removed from (e.g., translated in the lateral direction 11*b* out of) the aperture 38*a*.

Movement of an exterior portion 24*a*, 24*b* may determine to which end of an aperture 38*a* the horizontal member 18 may be biased. For example, as an exterior portion 24*a*, 24*b* moves up a corresponding interior portion 26*a*, 26*b*, then a corresponding end of the horizontal member 18 may be biased toward engagement with an extension 40*a*. Conversely, as an exterior portion 24*a*, 24*b* moves down a corresponding interior portion 26*a*, 26*b*, then a corresponding end of the horizontal member 18 may be biased away from engagement with an extension 40*a*.

By engaging one or more interior portions 26*a*, 26*b*, a base 12 may control or limit the motion of the one or more interior portions 26*a*, 26*b* with respect to the corresponding exterior portions 24*a*, 24*b*. Accordingly, a base 12 may secure or lock one or more interior portions 26*a*, 26*b* in positions corresponding to engagement between an extension 40*a*, 40*b* and corresponding groove 44. Thus, when a shackle 12 is locked by a base 12, a horizontal member 18 thereof may be locked in an closed position 66.

In selected embodiments, it may be desirable for a user to selectively manipulate an interior portion 26*a*, 26*b* with respect to a corresponding exterior portion 24*a*, 24*b*. Accordingly, one or both of an interior portion 26*a*, 26*b*, and an exterior portion 24*a*, 24*b* may include one or more structures 78 enabling a user to grip or manipulate the components. For example, in selected embodiments, an interior portion 26*a*, 26*b* may include a fingernail groove 78 enabling a user to lift the interior portion 26*a*, 26*b* with respect to a surrounding exterior portion 24*a*, 24*b*.

In certain embodiments, a horizontal member 18 may be connected to a tether 80 (e.g., a flexible tether 80). A tether 80 may comprise chain, cable, or the like. In selected embodiments, a tether 08 may secure to a horizontal member 18 and extend therefrom to engage (e.g., loop through or around) one or more items or an anchor. An anchor may be an object that is substantially fixed in place (e.g., an embedded post or the like). Alternatively an anchor may be an object sufficiently heavy, bulky, or both to render moving the object unpractical or undesirable. For example, an anchor may comprise a desk, table, or the like that may be moved or dismembered, but only with significant effort or with the generation of unwanted attention from surrounding individuals.

Referring to FIGS. 23-26, a shackle 14 in accordance with the present invention may be used to occupy an item or otherwise prevent its being used in a particular manner.

For example, in selected embodiments, a horizontal member 18 may be used to occupy or secure an electrical plug to prevent the plug from being inserted within a power outlet.

In such embodiments, a shackle 14 may include an interface 82. The interface 82 may cooperate with one or more of the vertical and horizontal members 16*a*, 16*b*, 18 to form one or more apertures 84 for receiving one or more prongs of a plug therewithin. Certain prongs may have apertures formed therein. Accordingly, once a plug has been inserted with an interface 82 (e.g., once one or more prongs of a plug have been inserted within corresponding apertures 84), a horizontal member 18 may be inserted through the apertures in certain prongs. The assembled shackle 14 may then be secured to a base 12. Thus, the plug may be locked within the interface 82 and, therefore, inaccessible for use.

In certain embodiments, an interface 82 may comprise one or more of a housing 86, connector 88, and support 90. A housing 86 may define the exterior of the interface 82. In selected embodiments, a housing 86 may include a flat portion 92 facilitating engagement with an electrical plug. A connector 88 may connect a housing 86 to one vertical member 16*a*, 16*b*. In certain embodiments, a connector 88 may comprise a pivot, enabling the housing 86 to rotate about an axis extending parallel to the lateral direction 11*b*. A support 90 may be positioned within a housing 86 at a location between two prong apertures 84. A support 90 and pivot 88 may each include an aperture 94 for receiving the horizontal member 18 therewithin. A support 90 and pivot 88 may support a horizontal member 18 against loads (e.g., bending loads) imposed thereon by an authorized user (e.g., a user unable to unlock the base 12) who attempts to pull a plug from the interface 82.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A padlock defining longitudinal, lateral, and transverse directions extending substantially orthogonally with respect to one another, the padlock comprising:

a base comprising a latching mechanism, a first aperture extending in the longitudinal direction, and a second aperture extending in the longitudinal direction; and a shackle selectively engaging the base and comprising a first member extending in the longitudinal direction and having a first anchor and a first post, the first anchor extending within the first aperture, the first post connecting to the first anchor and extending away therefrom, a second member extending in the longitudinal direction and having a second anchor and a second post, the second anchor extending within the second aperture, the second post connecting to the second anchor and extending away therefrom, the second post having an extension, the second member comprising a lateral aperture extending in the lateral direction therewithin, and a third member extending in the lateral direction from a first end to a second end, the first end engaging the first post, the second end removably extending into the lateral aperture of the second post, a circumferential groove being formed proximal to the second end and a lateral groove being formed from the circumferential groove to the second end, the extension of the second post being configured to extend into the lateral groove.

2. The padlock of claim 1, wherein the first post, second post, and third member are substantially cylindrical in shape.

3. The padlock of claim 1, wherein the latching mechanism selectively secures at least one of the first and second anchors within the first and second apertures, respectively.

4. The padlock of claim 1, wherein the first end of the third member substantially permanently engages the first post.

5. The padlock of claim 1, wherein the extension extends into the circumferential groove at a location spaced from the lateral groove.

6. The padlock of claim 1, wherein the extension extends into the circumferential groove at a location substantially opposite the lateral groove.

7. The padlock of claim 1, wherein the extension extends into the circumferential groove and resists withdrawal in the lateral direction of the third member from the second post.

8. A method of operating a padlock defining longitudinal, lateral, and transverse directions extending substantially orthogonally with respect to one another, the method comprising:

obtaining a padlock comprising a base comprising a latching mechanism, a first aperture extending in the longitudinal direction, and a second aperture extending in the longitudinal, and a shackle comprising a first member extending from within the first aperture, a second member extending from within the second aperture, and a third member extending in the lateral direction from a first end engaging the first member to a second end engaging the second member, the third member comprising a circumferential groove extending circumferentially thereabout at a location proximate the second end and a lateral groove extending in the lateral direction from the circumferential groove to the second end;

releasing the latching mechanism;

removing, after the releasing, the second member from the second aperture;

separating, after the removing, the second member from the third member;

passing, after the separating, the third member through at least one item;

engaging, after the passing, the second member with the third member; and inserting, after the engaging, the second member into the second aperture.

9. The method of claim 8, wherein the obtaining further comprises obtaining the padlock with the second member comprising:

a lateral aperture extending in the lateral direction; and an extension extending into the lateral aperture.

10. The method of claim 9, wherein the obtaining further comprises obtaining the padlock with the extension extending into the circumferential groove at a location spaced from the lateral groove.

11. The method of claim 10, wherein the separating comprises:

rotating the second member about the second end of the third member;

aligning the extension with the lateral groove; and translating the second member off of the second end of the third member.

12. The method of claim 11, wherein the translating comprises passing, by the extension, within the lateral groove.

* * * * *